US006389662B1

(12) United States Patent
Hamm, Jr.

(10) Patent No.: US 6,389,662 B1
(45) Date of Patent: May 21, 2002

(54) SECURITY CLUTCH WITH UNITARY TRIGGER AND SPRING

(75) Inventor: David Henry Hamm, Jr., Rehoboth, MA (US)

(73) Assignee: B.A.Ballou & Co., Inc., East Providence, RI (US)

( * ) Notice: Subject to any disclaimer, the term of this patent is extended or adjusted under 35 U.S.C. 154(b) by 0 days.

(21) Appl. No.: 09/614,327

(22) Filed: Jul. 12, 2000

(51) Int. Cl.[7] ..... A44C 7/00
(52) U.S. Cl. ..... 24/705
(58) Field of Search ..... 24/652, 658, 656, 24/657, 707.1, 708.4, 705; 63/12, 13

(56) References Cited

U.S. PATENT DOCUMENTS

| | | | | |
|---|---|---|---|---|
| 966,544 A | * | 8/1910 | Heaton | |
| 1,114,869 A | | 10/1914 | Donaldson | |
| 1,246,868 A | | 11/1917 | Bulley | |
| 1,277,258 A | | 8/1918 | Raiche | |
| 1,300,105 A | * | 4/1919 | Arkin | |
| 1,402,827 A | | 1/1922 | Arkin | |
| 1,531,757 A | * | 3/1925 | Rogers | |
| 3,523,339 A | | 8/1970 | Viano | 24/155 |
| 3,765,064 A | | 10/1973 | Hoober et al. | 24/211 |
| 3,948,547 A | | 4/1976 | Gache | 285/317 |
| 4,184,343 A | * | 1/1980 | Green | |
| 4,310,953 A | | 1/1982 | Nanasi | 24/230 AL |
| 4,382,317 A | * | 5/1983 | McDonald et al. | |
| 4,425,687 A | * | 1/1984 | Sauer | |
| 5,588,309 A | | 12/1996 | Chioffe | 63/12 |
| 5,845,378 A | | 12/1998 | Karmeli et al. | 24/705 |
| 5,894,641 A | | 4/1999 | Hurtz et al. | 24/658 |
| 5,970,588 A | | 10/1999 | Hurtz et al. | 24/657 |
| 5,983,669 A | * | 11/1999 | Karmeli | |

FOREIGN PATENT DOCUMENTS

| | | |
|---|---|---|
| FR | 1101361 | * 10/1955 |
| FR | 1155521 | * 5/1958 |
| FR | 2385351 | * 10/1978 |
| FR | 2474838 | * 8/1981 |

* cited by examiner

*Primary Examiner*—James R. Brittain
(74) *Attorney, Agent, or Firm*—Barlow, Josephs & Holmes, Ltd.

(57) ABSTRACT

A security clutch for a jewelry post includes a housing defining a post receiving aperture extending therethrough and an access port. A trigger lock member is disposed in said housing and includes a main body with an aperture therethrough defining a central post locking notch. A biasing member is connected to one end of the main body and a trigger portion is connected to opposing end to extend through the access port in the housing for manipulation from outside said housing. When the trigger is depressed against the biasing force of the biasing member, the main body is moved from a resting locked position to an unlocked position with the post locking notch being clear of the post receiving aperture, thereby permitting free passage of a jewelry post within the post receiving aperture. As a result, the security clutch can be easily and quickly installed and removed from a jewelry post when desired.

9 Claims, 4 Drawing Sheets

SECURITY CLUTCH WITH UNITARY TRIGGER AND SPRING

BACKGROUND OF THE INVENTION

The present invention relates to clutches and clasps and more particularly to a security clutch for a jewelry post, such as an earring post.

Security clutches or clasps are widely used for connection to a grooved jewelry post to secure the jewelry post in place. A jewelry post is commonly provided with an ornamented end and a free end. The ornamented end, for example, may carry a pearl, gemstones, metal cast design or other decorative structure. The opposing free end is inserted through a pierced ear. The free end of the post includes at least one circumferential groove to receive a clutch or clasp on the post on the opposite side of the ear to the ornamented end to secure the entire assembly in place on the ear. The clutch releasably engages the post and is of an enlarged area to prevent accidental removal of the post from the pierced ear. A security clutch can be removed and attached to the free end of the post for installation and removal of the earring assembly on the user's pierced ear. Additional circumferential grooves can also be provided to secure the clutch closer or farther away from the ornamented end in accordance with the thickness of the user's ear and their respective comfort level.

In view of the foregoing, the employment of a clasp or clutch to secure a jewelry post is critical so that it is does not fall out of the user's ear. Other non-earring jewelry posts have the same requirement. In the prior art, there have been many attempts to provide a security clutch for a grooved jewelry post. For example, the prior art includes various clutches with an integrated spring-biased locking member that obstructs a post receiving aperture positioned through the clutch. The integrated locking member typically includes a complex construction with many components and delicate springs. Many prior art devices include two opposing trigger buttons to control the positioning of a locking member located inside the housing.

As a result, these prior art devices are expensive to manufacture and labor intensive to assemble. The delicate and complicated parts are very small in size and are very difficult to assemble properly. Further, these prior art devices are difficult and cumbersome to operate by the user. In sum, these prior art devices are inadequate to meet the user's needs.

In view of the foregoing, there is a demand for an improved security clutch with a minimal number of component parts to facilitate manufacturing and assembly and to reduce cost without sacrificing quality and performance. There is also a demand for a security clutch that can install onto a standard grooved jewelry post. There is a further demand for a security clutch that has only a single trigger for ease of operation, a low profile for comfort and a positive lock.

SUMMARY OF THE INVENTION

The present invention preserves the advantages of prior art security clutches for jewelry posts. In addition, the security clutch for jewelry posts provides new advantages not found in currently known devices and overcomes many disadvantages of such currently available devices.

The invention is generally directed to the novel and unique security clutch for jewelry posts, such as grooved posts. A security clutch for a jewelry post includes a housing defining a post receiving aperture extending therethrough to define an access port. A trigger lock member is disposed in said housing and includes a main body with an aperture therethrough defining a central post locking notch. A biasing member is connected to one end of the main body and a trigger portion is connected to opposing end to extend through an access port in the housing for manipulation by the user from outside the housing. When the trigger is depressed against the biasing force of the biasing member, the main body is moved from a resting locked position to an unlocked position with the post locking notch being clear of the post receiving aperture, thereby permitting free passage of a jewelry post within the post receiving aperture. As a result, the security clutch can be easily and quickly installed and removed from a jewelry post when desired.

In operation, the button portion is depressed by the user, against the forces of the spring-biasing member to clear the locking notch from the post receiving aperture and from the groove of the grooved post to permit free movement of a jewelry post within the post receiving aperture. As a result, the security clutch of the present invention can be easily attached and removed from a jewelry post quickly by depressing only a single button and use of a unitary trigger and spring member. Further, the security clutch of the present invention easily engages with a groove of a grooved post to prevent the security clutch from being removed without first depressing the button portion.

Accordingly, it is a primary object of the instant invention to provide a security clutch for jewelry posts.

Another object of the instant invention is to provide a security clutch for jewelry posts that can be easily installed and removed.

Still further, an object of the instant invention is to provide a security clutch for jewelry posts that securely locks to a grooved jewelry post.

It is yet another object of the present invention to provide a security clutch for jewelry posts that can be locked and unlocked by depression of a single button.

A further object of the present invention is to provide a security clutch for jewelry posts that has a unitary trigger and spring configuration and has fewer parts than prior art security clutches.

Another object of the present invention is to provide a security clutch for jewelry posts that is simple and easy to manufacture and assemble.

Yet a further object of the present invention is to provide a security clutch for jewelry posts that has a positive lock.

Another object of the present invention is to provide a security clutch for jewelry posts that can accommodate single and multiple grooved posts.

A further object of the present invention is to provide a security clutch for jewelry posts that has a low profile.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
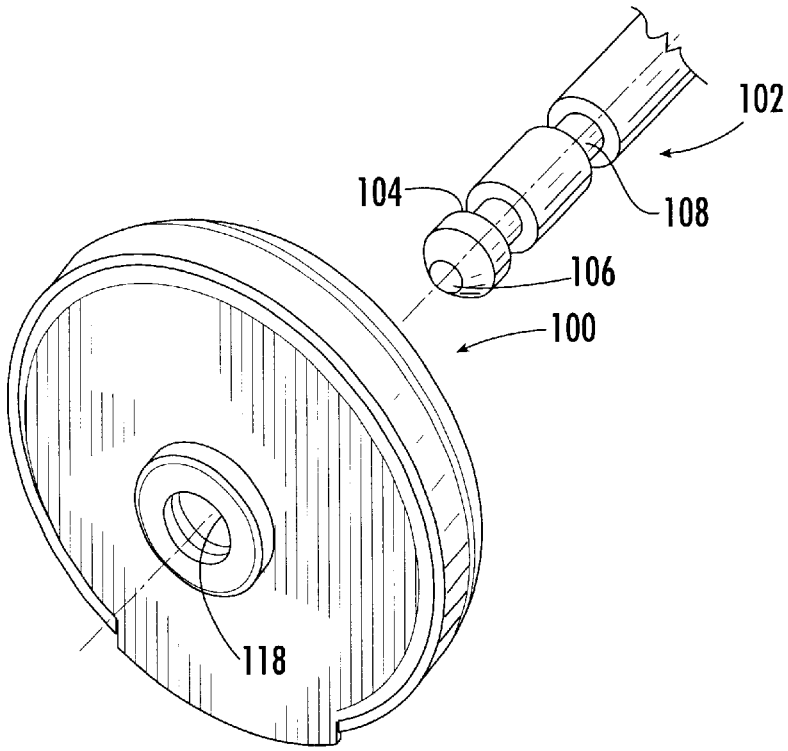
FIG. 1 is a perspective view of the security clutch of the preferred embodiment in the process of being installed on a multiple grooved jewelry post.

Referring first to FIG. 1, a perspective view of the security clutch 100 of the present invention is shown in the process of being installed on a grooved jewelry post 102. By way of example, the security clutch 100 of the present invention is shown for installation onto a double groove jewelry post 102 for an earring (not shown). It should be understood that the present invention may be used to secure to any type of jewelry post 102 for a wide array of jewelry applications.

Figure 2:
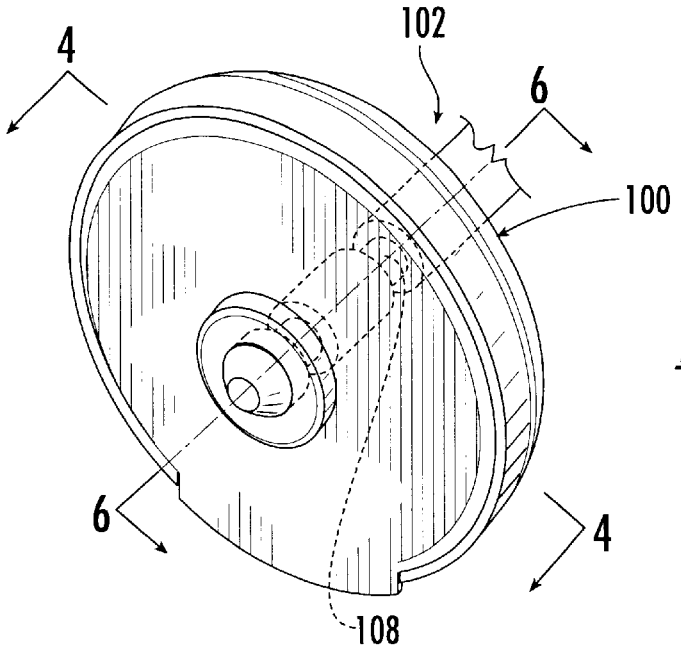
FIG. 2 is a perspective view of the security clutch of the present invention installed on a multiple grooved jewelry post.

Still referring to FIG. 1, the security clutch 100 can be attached to the shown double grooved jewelry post 102. In particular, the clutch 100 is shown being attached to the first groove 104 proximal to the end 106 of the post 102. The attachment of the security clutch 100 to the second groove 108 is identical to the attachment to the first groove 104 and need not be discussed in detail. The security clutch 100 can be secured to the free end 106 of the jewelry post 102. FIG. 2 shows the security clutch 100 of the present invention installed on the free end 106 of the jewelry post 102. The security clutch 100 can also be secured to the second groove 108 on the jewelry post 102. The construction and operation of the security clutch 100 of the present invention will be shown in detail below.

Figure 3:
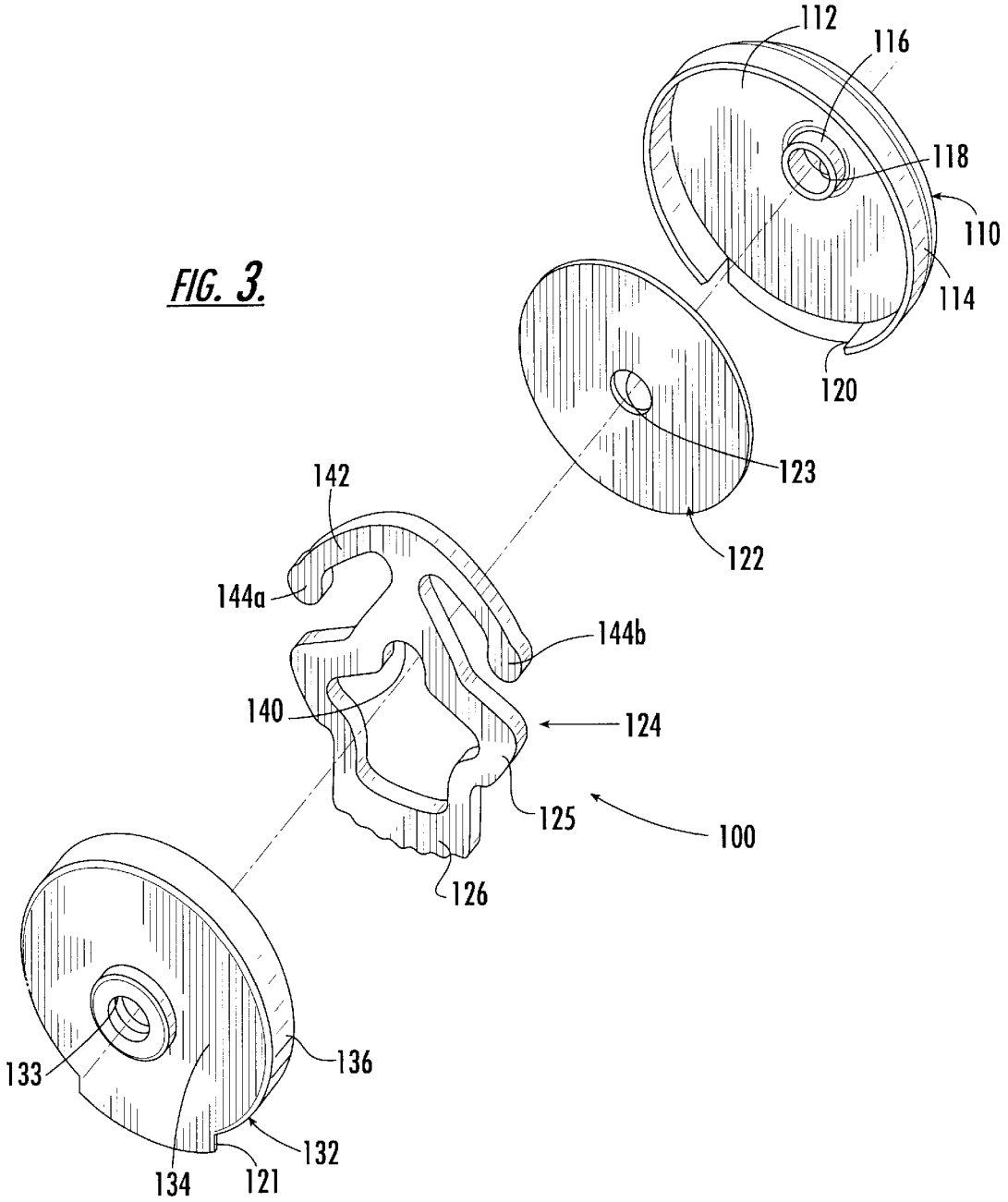
FIG. 3 is an exploded perspective view of the security clutch of the present invention.

Referring now to FIG. 3, an exploded perspective view of the security clutch 100 of the present invention is shown. An upper housing shell 110 is provided with a top plate 112 and a downwardly depending wall 114. A boss 116 is provided with an upper post receiving aperture 118 positioned therethrough. A cut-out 120 is provided in the downwardly depending wall 114. A washer 122, with pass-through hole 123, is preferably employed and positioned within the upper housing shell 110. A unitary trigger spring member 124 is positioned adjacent to the washer 122 for stability and alignment normal to the axis through the post receiving aperture 118. A main body 125 includes a trigger portion 126 which extends outwardly from the upper housing shell 110 through the cut-out 120 in the downwardly depending wall 114. A spring member 142, with spring-biased free ends 144*a* and 144*b*, is connected to the opposing side of the main body 125 as the trigger portion 126. The main body also defines a post receiving surface or locking notch 140, as will be described in detail below. A lower housing shell 132 with a lower plate 134 and pass-through hole 133 and side wall 136 engages with the upper housing shell 110 so the side wall 136 of the lower housing shell 132 frictionally engages with the inner side of the downwardly depending wall 114 of the upper housing shell 110. The unitary trigger spring member 124 and washer 122 are sealed within the housing formed by the upper housing shell 110 and the lower housing shell 132. For simplicity, apertures 118, 123, 131 and 133 are collectively referred to as a post-receiving aperture 118 when addressing the entire security clutch 100.

Figure 4:
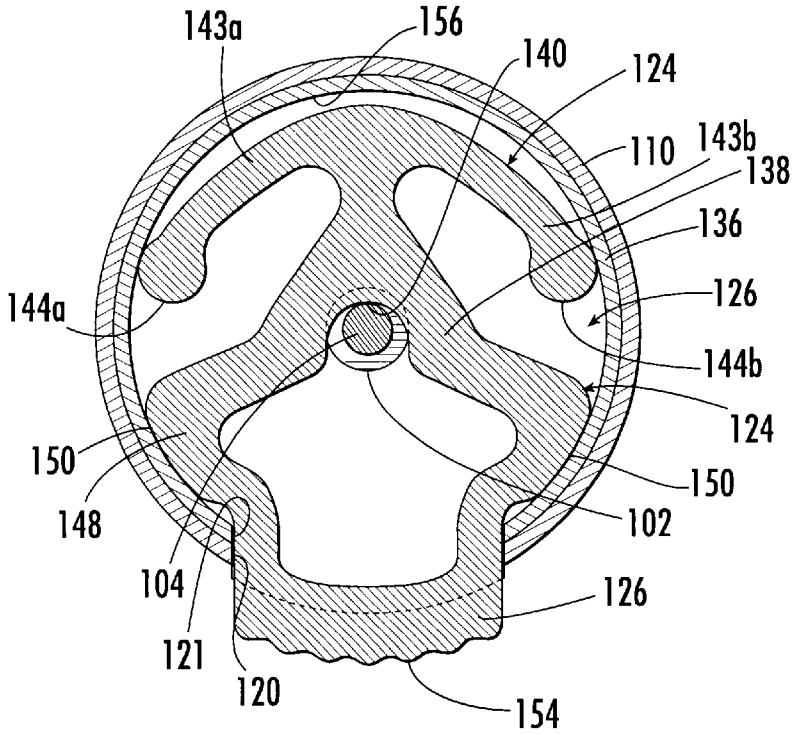
FIG. 4 is a cross-sectional view through the line 4—4 of FIG. 2 showing the security clutch in a locked position.
Figure 5:
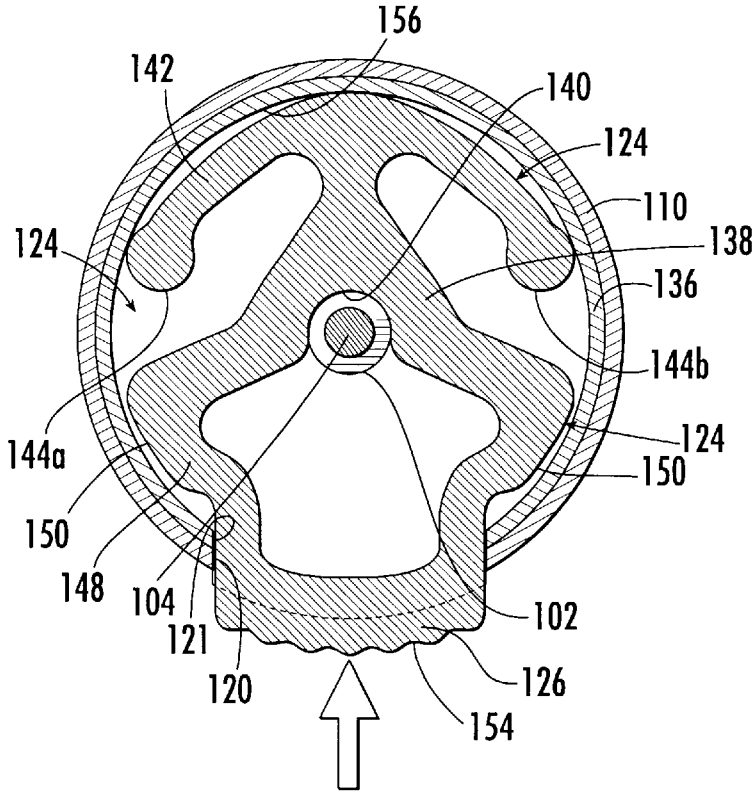
FIG. 5 is the cross-sectional view of FIG. 4 showing the security clutch in an unlocked position with trigger portion depressed.
Figure 6:
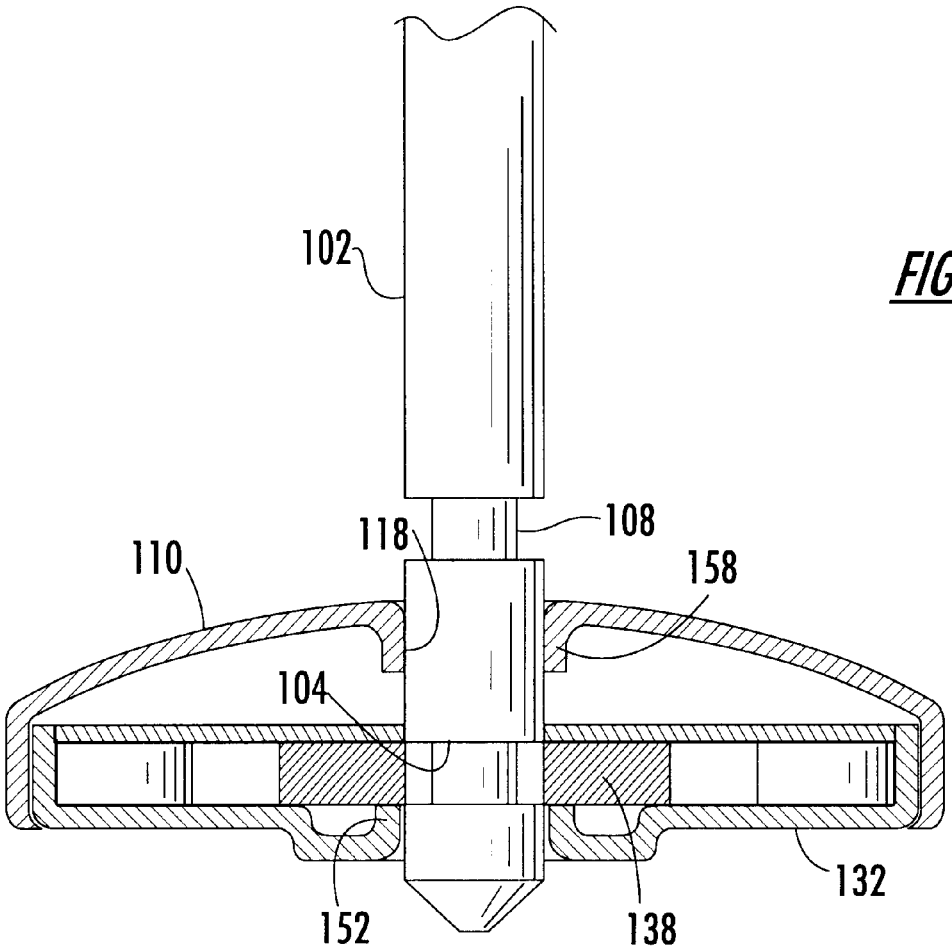
FIG. 6 is a partial cross-sectional view through the line 6—6 of FIG. 2.

Referring now to FIGS. 4–6, the construction and operation of the security clutch 100 of the present invention is shown in more detail. For ease of illustration, the lower plate 134 of the lower housing shell 132 and washer 122 are not illustrated to permit clear view of the positioning of the unitary trigger spring 124. In FIG. 4, the security clutch 100 is shown in a locked state and installed on a jewelry post 102. In this condition, the device 100 is in a locked position. The unitary trigger spring 124 includes a U-shaped portion 138 with a post receiving surface or locking notch 140. A spring portion 142 includes free ends 144*a* and 144*b* that contact and bear against the inside surface of the side wall 136 of the lower housing 132.

In the FIG. 4, the spring portion 142 urges the U-shaped portion 138 toward the post receiving aperture 118 (not shown in FIGS. 4 and 5) so that the post receiving surface 140 of the U-shaped portion 138 resides within the post receiving aperture 118 and is engaged with the groove 104 of post 102. As shown both in FIGS. 4 and 6, a grooved post 102 positioned within the post receiving aperture 118 receives the U-shaped portion 138 so that the U-shaped portion 138 seats within the groove 104 of the post 102 in a positive locking fashion to be secured in place by the spring-biasing of the spring member 142. A double-grooved post 102 is shown in FIG. 6 as an example of the type of post 102 that can be accommodated by the security clutch 100 of the present invention. The clutch 100 is shown engaged with the top groove 104; however, the clutch 104 may be easily positioned on the lower groove 108 to suit the desired positioning of the clutch 100 on the post 102.

In this locked condition, the U-shaped member 138, with the spring-biasing of the spring member 142, urges the contact plate portion 148 of the main body 124 toward the opposite side of the side wall 136 of the lower housing shell 132. The arcuate opposing surfaces 150 of the contact plate 148 rest against the inside surface of the side wall 136 of the lower housing shell 132. This serves as a stop to prevent over travel of the U-shaped portion 138. The trigger portion 126 is integrally connected to the contact plate 148 and protrudes outside the lower housing shell 132 and the upper housing shell 110 through respective cut-outs 120 and 121 therein. A roughened surface 154 is provided on the button portion 152 of the trigger 126 for improved grip by the user.

In FIG. 5, the unlocking of the device 100 is shown. The trigger portion 126 is depressed in a direction, as shown by the indicated arrow, toward the post 102 to urge the U-shaped portion 138 away from the post 102 against the spring-biasing forces of the spring member 142. As a result of the depression of trigger portion 126, the U-shaped portion 138 is cleared from the post 102 to permit free travel of the post 102 therein. The opposing side of the spring 142, that is not connected to the U-shaped member 138, bears against the inner surface 156 of the side wall 136 of the lower housing shell 132 to serve as a stop to prevent over travel of the U-shaped member 138 away from the post 102.

In operation, to install the security clutch 100 of the present invention, the trigger portion 126 is depressed to clear the post receiving aperture 118. A grooved post 102 is inserted into the post receiving aperture 118 with the groove 104 aligned with the security clutch 100. The trigger portion 126 is released whereby the U-shaped portion 138 engages the groove 104 of the post 102 thus positively locking the clutch 100 to the post 102. To remove the clutch 100 from the post 102, the trigger portion 126 is again depressed and the post 102 is removed from the cleared post receiving aperture 118.

It is preferred that the components of the security clutch 100 of the present invention be manufactured of metal, such as ferrous and non-ferrous metal. For example, the washer 122 is, preferably, 420 stainless steel while all other components are, preferably, gold. Other than the washer 122, the other components may also be platinum. However, other materials, such as plastic may be used to suit the application. It is also preferred that the trigger portion 126 travel as little as possible to facilitate operation. For example, the trigger 126 preferably protrudes only 0.025 inches and travels only 0.008 inches to unlock.

It should understood that the construction of the upper housing shell 110 and lower housing shell 132 may be modified in accordance with the application at hand and still be within the scope of the present invention. For example, molded or cast housing may be employed instead of the preferred mating shell construction discussed above. Further, the washer 122 is provided for spacing and for maintaining the main body 124 in a plane that is normal to the axis of the post receiving aperture 118. Also, the washer 122 serves as a spacer to provide a flat supporting surface for the main body 124. A bottom boss 152 in the bottom housing 132 and a top boss 158 in the top housing 110 are employed to provide additional alignment and security of the post 102 received through the post receiving aperture 118 of the security clutch 100 of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A security clutch for a jewelry post with a circumferential groove, comprising:

a cylindrical housing including a top plate and a bottom plate and a wall extending therebetween; said housing defining a post receiving aperture extending through said top plate and said bottom plate; said wall defining an access port therethrough;

a trigger lock member disposed in said cylindrical housing and between said top plate and said bottom plate; said trigger lock member including a main body with an aperture therethrough defining a post locking notch centrally located therein; said main body having a first end and an opposing second end and a left side and a right side; a biasing member connected to said first end of said main body; said biasing member having a left spring member in communication with the cylindrical housing and a right spring member in communication with the cylindrical housing and spring-biasing said main body toward said post receiving aperture; a trigger portion connected to said second end and extending through said access port in said wall and capable of manipulation from outside of said housing; a left shoulder stop emanating from the left side of the main body and a right shoulder stop emanating from the right side of the main body; the left shoulder stop and right shoulder stop being capable of communicating with the housing; and said main body being movable, by depression of said trigger portion against the biasing force of said biasing member, from a resting locked position with said post locking notch partially blocking said post receiving aperture and residing within said circumferential groove of said jewelry post thereby securing said jewelry post relative to said housing, with the left shoulder and the right should in communication with the housing, to an unlocked position with said post locking notch being clear of said post receiving aperture and the left shoulder and the right shoulder not in communication with the housing, thereby permitting free passage of said jewelry post within said post receiving aperture.

2. The security clutch of claim 1, wherein said biasing member is a pair of leaf springs.

3. The security clutch of claim 1, wherein said housing further includes a bottom shell and a top shell mated together.

4. The security clutch of claim 1, further comprising:

a washer, with a washer aperture therethrough, disposed between said main body and said top plate; said washer aperture being coaxial with said post receiving aperture.

5. The security clutch of claim 1, further comprising:

a bottom boss emanating upwardly from said bottom plate and surrounding said post receiving aperture through said bottom plate.

6. The security clutch of claim 1, further comprising:

a top boss emanating downwardly from said top plate and surrounding said post receiving aperture through said top plate.

7. The security clutch of claim 1, wherein said housing, said main member, said biasing member, said washer and said trigger portion are manufactured of metal.

8. The security clutch of claim 7, wherein said housing, said main member, said biasing member said trigger portion are manufactured of gold.

9. The security clutch of claim 6, wherein said washer is manufactured of stainless steel.

* * * * *